US009701130B2

(12) United States Patent
Misumi

(10) Patent No.: US 9,701,130 B2
(45) Date of Patent: Jul. 11, 2017

(54) APPARATUS AND METHOD FOR INSPECTING INKJET PRINT HEAD

(71) Applicant: CANON KABUSHIKI KAISHA, Tokyo (JP)

(72) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/564,360

(22) Filed: Dec. 9, 2014

(65) Prior Publication Data

US 2015/0165803 A1 Jun. 18, 2015

(30) Foreign Application Priority Data

Dec. 17, 2013 (JP) ..... 2013-260499

(51) Int. Cl.
*B41J 29/38* (2006.01)
*B41J 2/21* (2006.01)
*B41J 2/175* (2006.01)

(52) U.S. Cl.
CPC ..... *B41J 2/2135* (2013.01); *B41J 2/17553* (2013.01); *B41J 2/2142* (2013.01); *B41J 29/38* (2013.01)

(58) Field of Classification Search
USPC ..... 347/14, 45, 40, 41, 5, 9
See application file for complete search history.

(56) References Cited

U.S. PATENT DOCUMENTS 5,173,717 A 12/1992 Kishida et al.
6,149,259 A * 11/2000 Otsuka et al. ..... 347/12
8,201,907 B2 * 6/2012 Teshigawara ..... B41J 2/2135 347/12
2009/0002439 A1 * 1/2009 Hayashi et al. ..... 347/40

FOREIGN PATENT DOCUMENTS

JP 2010-143025 A 7/2010

* cited by examiner

*Primary Examiner* — Lam Nguyen
(74) *Attorney, Agent, or Firm* — Fitzpatrick, Cella, Harper & Scinto

(57) ABSTRACT

An apparatus and a method for inspecting an inkjet print head can accurately inspect the ink ejection performance of the inkjet print head. A predetermined inspection pattern is printed on a printing medium by dividing a plurality of ejection openings into a plurality of blocks to subject the inkjet print head to time division driving so that ink ejection timing is staggered for each of the blocks. The inspection pattern is read. Image data of the inspection pattern is subjected to image processing. Then, position displacement amounts of dots formed on the printing medium by ink ejected through the ejection openings are acquired. The acquired position displacement amounts are corrected for each block.

7 Claims, 18 Drawing Sheets

$$\overline{y} = \frac{1}{192} \sum_{i=0}^{191} y_i \quad \cdots\cdots\cdots (1)$$

$$Ya = \frac{1}{48} \sum_{i=0}^{47} y_{4i} \quad \cdots\cdots\cdots (2)$$

$$Yb = \frac{1}{48} \sum_{i=0}^{47} y_{4i+1} \cdots\cdots\cdots (3)$$

$$Yc = \frac{1}{48} \sum_{i=0}^{47} y_{4i+2} \cdots\cdots\cdots (4)$$

$$Yd = \frac{1}{48} \sum_{i=0}^{47} y_{4i+3} \cdots\cdots\cdots (5)$$

$$y'_{4i} = y_{4i} - (Ya - \overline{y}) \cdots\cdots\cdots (6)$$

$$y'_{4i+1} = y_{4i+1} - (Yb - \overline{y}) \cdots\cdots\cdots (7)$$

$$y'_{4i+2} = y_{4i+2} - (Yc - \overline{y}) \cdots\cdots\cdots (8)$$

$$y'_{4i+3} = y_{4i+3} - (Yd - \overline{y}) \cdots\cdots\cdots (9)$$

FIG.13

$$\sigma_y = \sqrt{\frac{1}{192}\sum_{i=0}^{191}(y_i - \overline{y})^2} \cdots\cdots\cdots (11)$$

$$\sigma_{y'} = \sqrt{\frac{1}{192}\sum_{i=0}^{191}(y'_i - \overline{y'})^2} \cdots\cdots\cdots (12)$$

FIG.14

$$\sigma_{y'a} = \sqrt{\frac{1}{48}\sum_{i=0}^{47}(y'_{4i} - \overline{y}a')^2} \cdots\cdots\cdots (21)$$

$$\sigma_{y'b} = \sqrt{\frac{1}{48}\sum_{i=0}^{47}(y'_{4i+1} - \overline{y}b')^2} \cdots\cdots (22)$$

$$\sigma_{y'c} = \sqrt{\frac{1}{48}\sum_{i=0}^{47}(y'_{4i+2} - \overline{y}c')^2} \cdots\cdots (23)$$

$$\sigma_{y'd} = \sqrt{\frac{1}{48}\sum_{i=0}^{47}(y'_{4i+3} - \overline{y}d')^2} \cdots\cdots (24)$$

$$\sigma_{y'} = \sqrt{\frac{1}{4}(\sigma_{y'a}^2 + \sigma_{y'b}^2 + \sigma_{y'c}^2 + \sigma_{y'd}^2)} \cdots\cdots (25)$$

FIG.17

APPARATUS AND METHOD FOR INSPECTING INKJET PRINT HEAD

BACKGROUND OF THE INVENTION

Field of the Invention

The present invention relates to an apparatus and a method for inspecting an inkjet print head through which ink for printing an image can be ejected.

Description of the Related Art

In a step of manufacturing an inkjet print head through which ink can be ejected, an inspection step for inspecting the ink ejection performance of a manufactured print head is provided to detect the landing position of an ink droplet ejected from the print head.

Such methods for inspecting the print head include, for example, a known method as disclosed in Japanese Patent Laid-Open No. 2010-143025. According to this method, while a medium for receiving ink droplets ejected from a print head is moved, ink is ejected through the print head to form ink dots on the medium, thereby an inspection pattern is printed. Then, the image of the inspection pattern is read and is subjected to an image processing. Then, a displacement amount of the positions of the dots formed on the medium by ink droplets are calculated to thereby evaluate the ejection performance of the print head.

The inspection step for carrying out the inspection method as described above is generally included in full-automatic assembly steps for manufacturing a print head. Therefore, a risk is caused in which the inspection step may be influenced by the vibration of apparatuses for performing steps before and after the inspection step and the vibration of an apparatus for performing the inspection step. For example, such a risk is caused in which the influence by these vibrations may deteriorate the accuracy at which ink droplets are landed during the printing of an inspection pattern and the accuracy at which a printed image of the inspection pattern is read, which may prevent the ejection status of the print head from being evaluated accurately. Print heads in recent years in particular have a reduced ink droplet size, an increased image printing resolution, and an increased number of ejection openings for ink ejection. Thus, there has been a need to further improve the landing accuracy at which ink droplets are landed during the printing of the inspection pattern.

SUMMARY OF THE INVENTION

The present invention provides an apparatus and a method for inspecting an inkjet print head by which the ink ejection status of the inkjet print head can be inspected accurately.

In the first aspect of the present invention, there is provided an apparatus for inspecting an inkjet print head in which ink can be ejected through a plurality of ejection openings forming an ejection opening array, comprising:

a control unit configured to print a predetermined inspection pattern on a printing medium by dividing the plurality of ejection openings to a plurality of blocks to subject the inkjet print head to a time division driving so that an ink ejection timing is staggered for each of the blocks;

a reading unit configured to read the inspection pattern printed on the printing medium;

an acquisition unit configured to subject image data of the inspection pattern read by the reading unit to an image processing to acquire position displacement amounts of dots formed on the printing medium by ink ejected through the ejection openings; and a correction unit configured to correct, for each block, the position displacement amounts of the dots acquired by the acquisition unit.

In the second aspect of the present invention, there is provided a method of inspecting an inkjet print head in which ink can be ejected through a plurality of ejection openings forming an ejection opening array, comprising:

a printing step of printing a predetermined inspection pattern on a printing medium by dividing the plurality of ejection openings to a plurality of blocks to subject the inkjet print head to a time division driving so that an ink ejection timing is staggered for each of the blocks;

a reading step of reading the inspection pattern printed on the printing medium;

an acquisition step of subjecting image data of the inspection pattern read by the reading step to an image processing to acquire position displacement amounts of dots formed on the printing medium by ink ejected through the ejection openings; and a correction step of correcting, for each block, the position displacement amounts of the dots acquired by the acquisition step.

According to the present invention, a print head is time division-driven to print an inspection pattern so that ink ejection timings from ejection openings divided to a plurality of blocks are staggered based on the respective blocks. Then, the dot position displacement amounts acquired from the printing result of the inspection pattern are corrected on the basis of a block unit. Thus, the dot position displacement amounts can be corrected so as to minimize the influence by temporally-changing vibration. As a result, when the printing of the inspection pattern and the reading of the inspection pattern are influenced by the vibration, the influence can be minimized and the ink ejection status of the inkjet print head can be determined accurately. Furthermore, the inkjet print head can be inspected in an accurate and low-cost manner without requiring a special apparatus or mechanism.

Further features of the present invention will become apparent from the following description of exemplary embodiments (with reference to the attached drawings).

BRIEF DESCRIPTION OF THE DRAWINGS

FIG. 13 illustrates an arithmetic expression used in the first embodiment of the present invention;

FIG. 14 illustrates an arithmetic expression used in the first embodiment of the present invention;

FIG. 17 illustrates an arithmetic expression used in the second embodiment of the present invention.

DESCRIPTION OF THE EMBODIMENTS

The following section will describe in detail an embodiment of the present invention with reference to the drawings.

First Embodiment

Figure 1A:
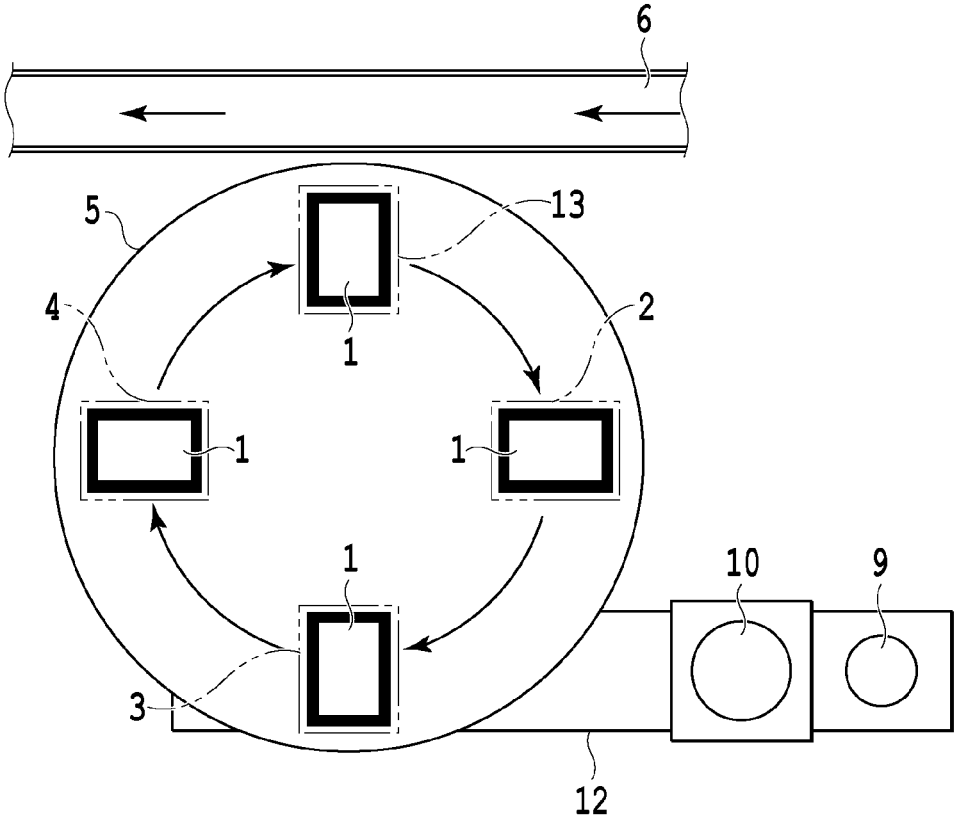
FIG. 1A and FIG. 1B are schematic views illustrating a configuration of an inspection apparatus in the first embodiment of the present invention, respectively.
Figure 1B:
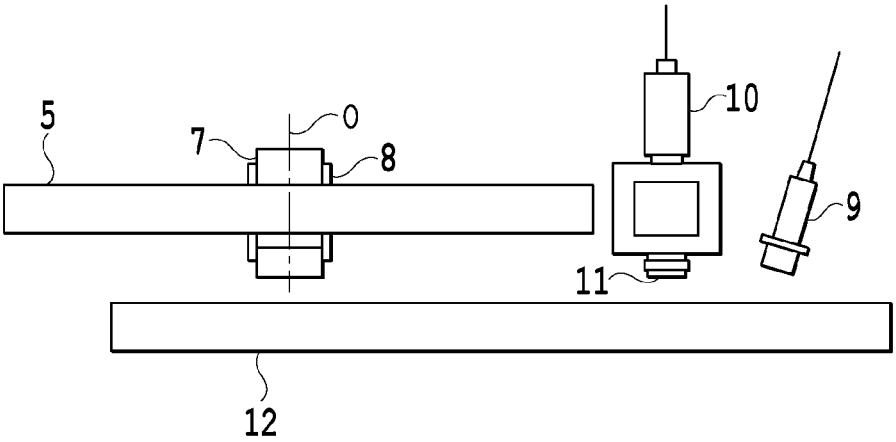

FIG. 1A is a top view of an inspection apparatus of an inkjet print head of this embodiment seen from above. FIG. 1B is a side view thereof.

The inspection apparatus of this example receives an inkjet print head 7 as an inspection target conveyed by a belt conveyor 6 in the previous step of the inspection step in the inspection apparatus. The inspection apparatus includes a rotary index 5 in which four head fixing portions 1 are provided at an equal interval of 90 degrees. By allowing the rotary index 5 to rotate around an axis line O in FIG. 1B by an increment of 90 degrees in the right direction in FIG. 1A, the four head fixing portions 1 are sequentially moved to positions of a carry-in/carry-out portion 13, a suction recovery portion 2, an image printing portion 3, and a weighing portion 4, respectively. The print head 7 carried by the belt conveyor 6 is inserted to the head fixing portion 1 positioned at the carry-in/carry-out portion 13 and is fixed by a clamp jig 8. The print head fixed to the head fixing portion 1 is moved to the suction recovery portion 2 by allowing the rotary index 5 to rotate in the right direction by 90 degrees. The print head in this suction recovery portion 2 is subjected to a suction recovery to suck ink in the print head through an ejection opening of the print head 7.

Thereafter, the print head 7 of the head fixing portion 1 is moved to the image printing portion 3 by allowing the rotary index 5 to further rotate by 90 degrees in the right direction. In the image printing portion 3, ink is ejected through the ejection opening onto a printing medium on an XYZ stage 12 to print an inspection image. The printed inspection image is read by a CCD camera (reading portion) 10 through a lens tube unit 11 and is subsequently subjected to an image processing and a calculation processing, thereby inspecting a printing status of the inspection image (i.e., an ink ejection status of the printing head 7). The inspection image is illuminated by an LED (illumination portion) 9 for example.

Thereafter, the print head 7 fixed to the head fixing portion 1 is moved to the weighing portion 4 by allowing the rotary index 5 to further rotate by 90 degrees and is weighed by the weighing portion 4. Thereafter, the print head 7 fixed to the head fixing portion 1 is moved to the carry-in/carry-out portion 13 by allowing the rotary index 5 to further rotate by 90 degrees in the right direction. In the carry-in/carry-out portion 13, the print head 7 is returned onto the belt conveyor 6 and is carried to the next processing step. Instead of the print head 7, a new print head 7 as an inspection target is fixed to the head fixing portion 1.

As described above, in the inspection apparatus of this example, the ink ejection status of the print head 7 is continuously inspected in accordance with the stepwise rotation of the rotary index 5 in an increment of 90 degrees.

Figure 2:
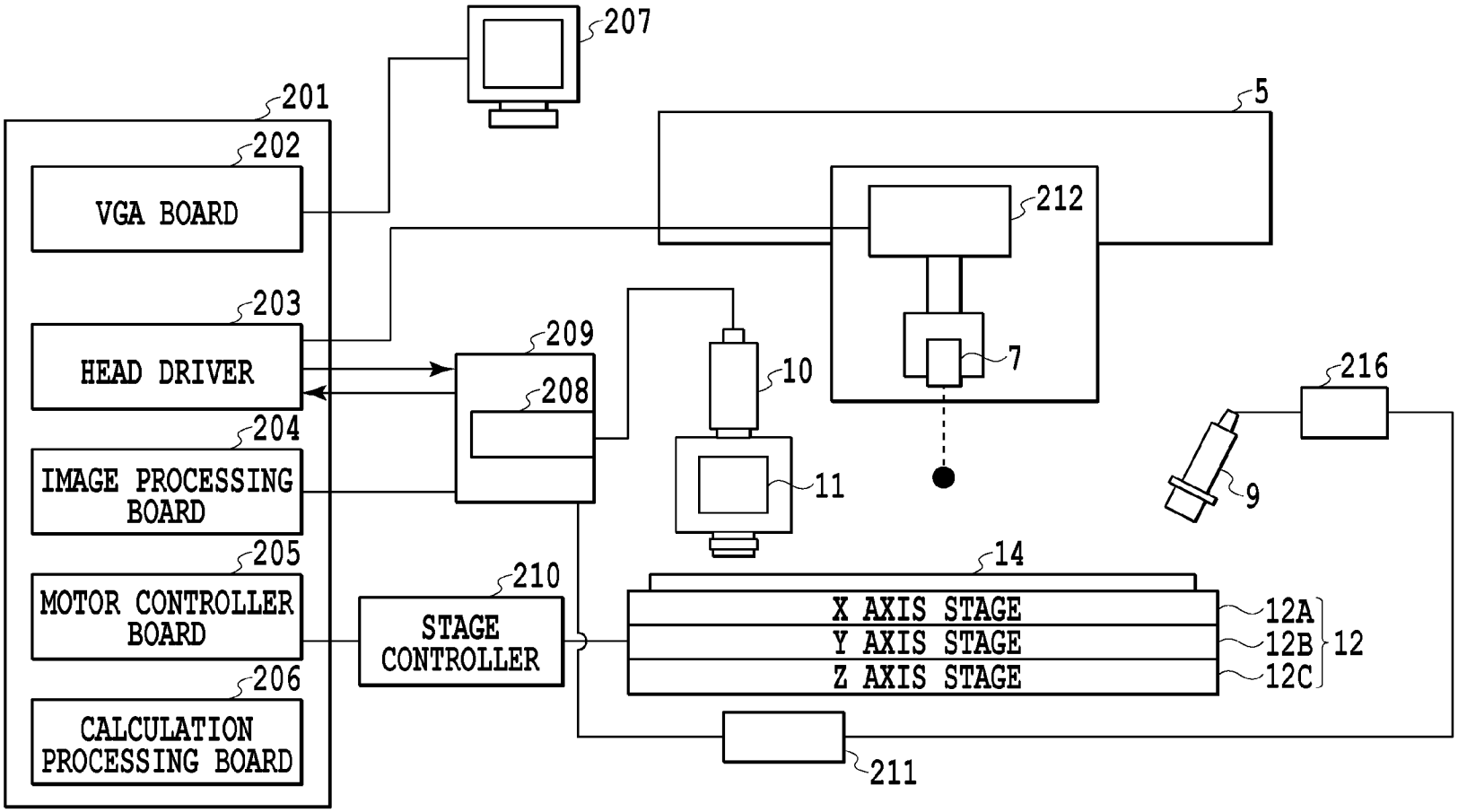
FIG. 2 is a schematic view illustrating a configuration of a main part of the inspection apparatus of FIG. 1A.

FIG. 2 is a schematic view illustrating the image printing portion 3.

In this image printing portion 3, the print head 7 fixed to the head fixing portion 1 of the rotary index 5 is connected to a signal conversion substrate 212. The print head 7 receives an ink ejection driving signal generated by a head driver 203 in a personal computer (control apparatus) 201. A signal synchronized with the timing at which ink is ejected is sent through a stage controller 210 to the XYZ stage 12. In synchronization with the travel of the stage 12, ink is ejected from the print head 7 through the ejection opening. As a result, an inspection pattern is printed on the printing medium on the XYZ stage 12. The inspection image is read by the camera 10 through the lens tube unit 11. The camera 10 is connected to a synchronization substrate 208 and a camera power source 209.

The inspection image read by the camera 10 is subjected by an image processing board 204 in the PC (personal computer) 201 to a background noise removal processing. Then, main dots formed by ink main droplets are extracted and are subjected to a binarization processing, thereby calculating gravity center points of the main dots. Based on the gravity center points of the plurality of main dots, a virtual grating is prepared by the least-square method to measure the displacement amount of the main dots from a grid point (ideal grid point). Based on the measurement result, the acceptability of the ink ejection status of the print head 7 is determined. The ideal grid point is set by the least-square method so that positions of the plurality of dots formed by ink ejected through the plurality of ejection openings have the minimum error under the conditions in which the positions of dots are equal spaced in the x direction and the y direction. The calculation processing as described above is performed by a calculation processing board 206 in the PC 201. The resultant processing image is sequentially outputted through a VGA board 202 to a monitor 207. The print head 7 and the camera 10 have absolute positions that are adjusted in advance by allowing a motor controller board 205 to control the XYZ stage 12 through the stage controller 210. The XYZ stage 12 has a configuration obtained by combining an X axis stage 12A, a Y axis stage 12B, and a Z axis stage 12C. The illumination portion (LED) 9 is connected to a light source unit 216 and an LED power source 211.

Figure 3A:
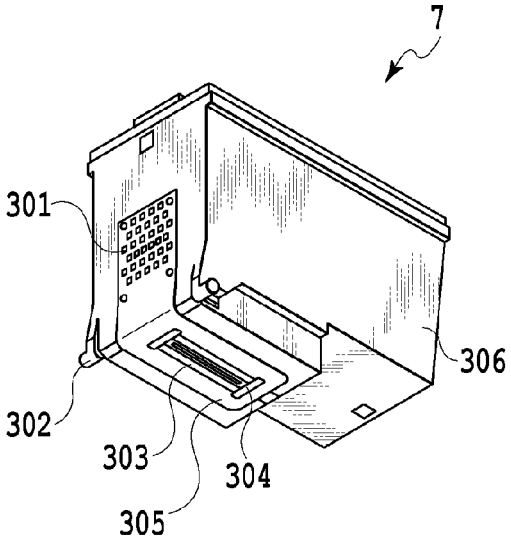
FIG. 3A and FIG. 3B are perspective views for explaining a configuration example of a print head.
Figure 3B:
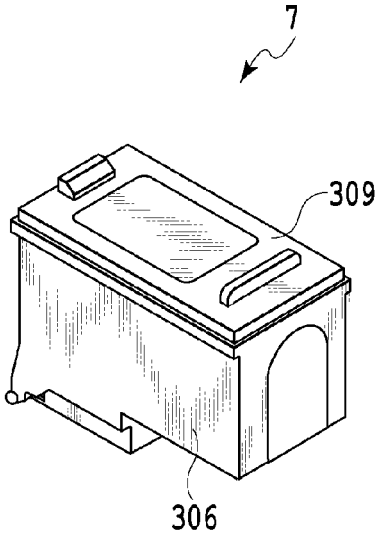

FIG. 3A is a perspective view illustrating a configuration example of the print head 7 seen from an ejection opening side. FIG. 3B is a perspective view illustrating the print head 7 seen from an ink tank side. The print head 7 of this example includes an electric wiring member 305 having a flying lead.

Examples of ink ejection method for ejecting ink from the print head 7 include a method of using an electromechanical conversion element such as a piezo element and a method of using an electrothermal transducer (heater). If the electrothermal transducer is used, heating of the electrothermal transducer causes ink to be foamed and the resulting foaming energy allows ink droplets to be ejected. Another method also may be used to irradiate ink with electromagnetic waves such as laser to heat the ink to use this heat for ink ejection. The print head 7 may have a tank-exchange configuration in which an ink tank can be detached or a configuration in which the print head is integrated with an ink tank.

The print head 7 of this example is integrated with the ink tank and is configured to eject ink using the electrothermal transducer. The print head 7 is a so-called side shooter-type ink jet print head in which the electrothermal transducer is opposed to an ink ejection opening in the ink ejection direction. The print head 7 is composed of: a substrate 303 having the electrothermal transducer (hereinafter also may be referred to as "heater") as an ejection energy generating element; an electric wiring member 305 having a flying lead, an ink supply retention member 306, a cap member 309, and an electric contact 301 for example. The print head 7 also has an engagement component 302 that can be engaged with a print head attachment portion in the printing apparatus.

Figure 4:
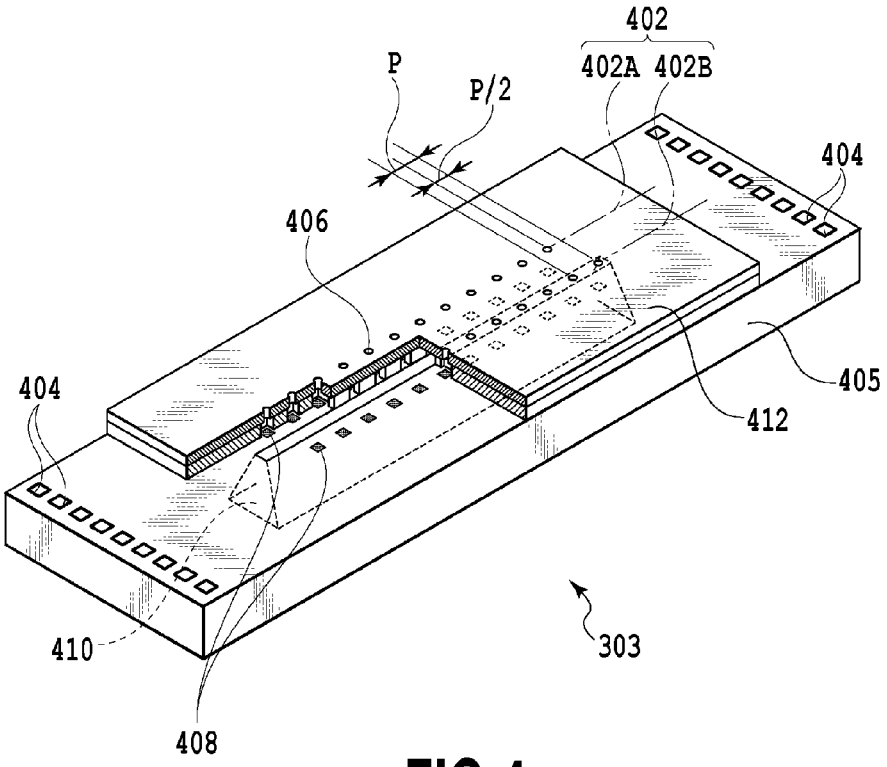
FIG. 4 is a partially-cutaway perspective view illustrating a substrate in the print head of FIG. 3A.

As shown in FIG. 4, the substrate 303 has a configuration in which a Si base material 405 includes an ink supply opening 410. The base material 405 is configured so that each of both sides of the ink supply opening 410 has one array of heaters 408 and electric wirings are also provided to supply electric power to the heaters 408. The heaters 408 in the respective arrays are arranged in a staggered manner. The ink supplied from the ink supply opening 410 is foamed by the heat generated from the heater 408 and is ejected by the pressure caused by the heat generation through ejection openings 406 opposed to the heaters 408. The ejection openings 406 are provided on a top panel 412 so as to form the arrays of the heaters 408 and the corresponding ejection opening arrays 402 (402A and 402B).

Figure 5:
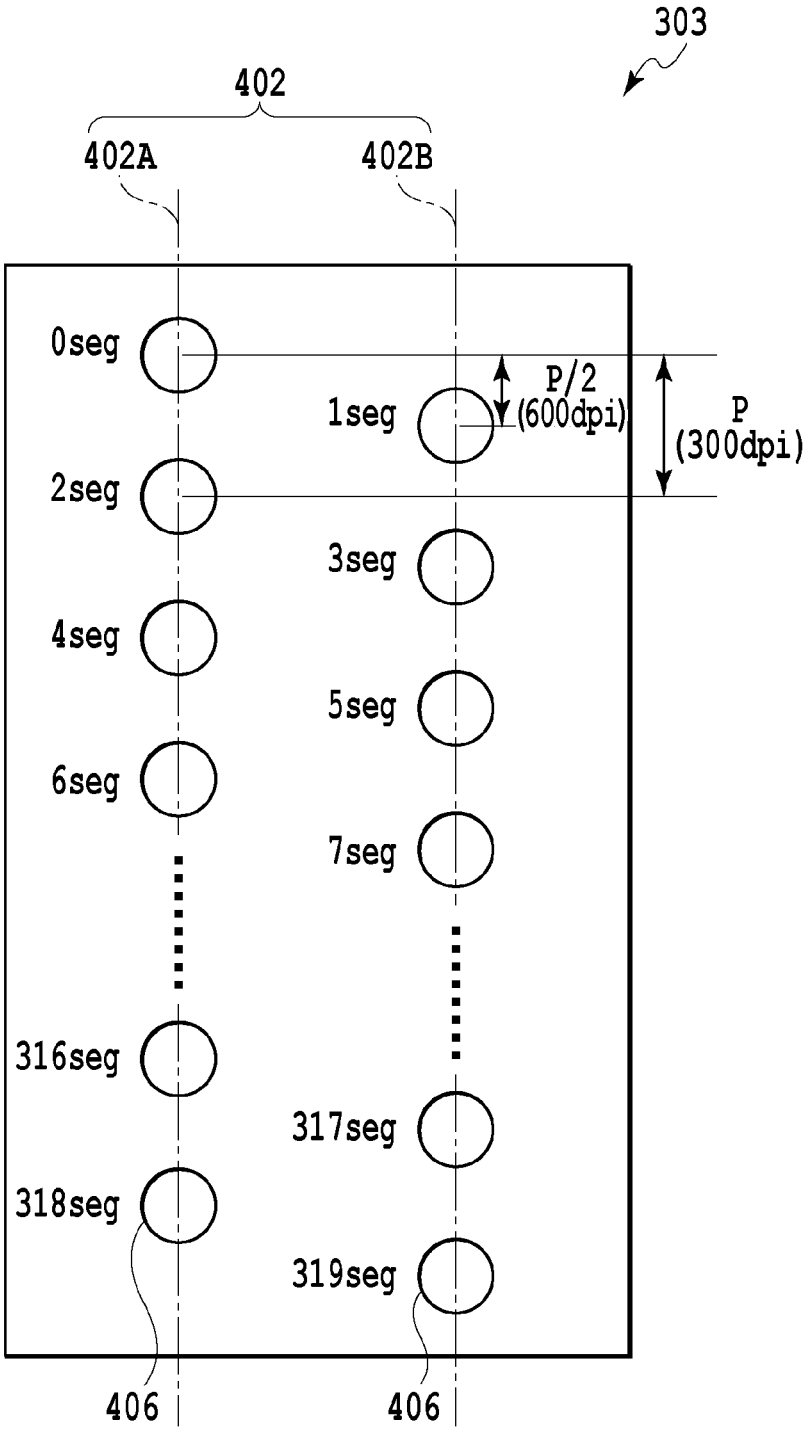
FIG. 5 is a top view illustrating a substrate of the print head of FIG. 4.

As shown in FIG. 5, the ejection openings 406 are arranged in a similar manner in which the heaters 408 are arranged. Specifically, the ejection openings 406 are arranged with a predetermined pitch P at the respective ejection opening arrays 402A and 402B. At the same time, the ejection openings 406 of the ejection opening array 402A and the ejection openings 406 of the ejection opening array 402B are staggered by a half pitch (P/2). The ejection opening array 402A is an even number array in which even number segments (0 seg to 318 seg) of the print head 7 are arranged. The ejection opening array 402B is an even number array in which even number segments (1 seg to 319 seg) of the print head 7 are arranged. In the case of this example, the pitch P corresponds to a 300 dpi printing resolution and a half pitch (P/2) corresponds to a 600 dpi printing resolution.

In FIG. 3A, the electric wiring member 305 forms an electric signal path to guide an ink ejection electric signal to the base material 405. The electric wiring member 305 includes an opening to install a substrate 303. In the vicinity of the edge of this opening, a flying lead portion is formed that is connected to an electric connection terminal of the substrate 303. Furthermore, the electric wiring member 305 includes an external signal input terminal functioning as an electric contact 301 for receiving an electric signal from the printing apparatus. This external signal input terminal and the flying lead portion are connected by a wiring pattern.

The ink supply retention member 306 includes therein an absorber to retain ink for generating a negative pressure, thereby providing a function of an ink tank. The ink in the ink supply retention member 306 is supplied between the base material 405 and the top panel 412 through the ink supply opening 410 of the base material 405. The base material 405 is fixedly adhered with a back face of a part of the electric wiring member 305. A connecting part at which the contact pad 404 of the base material 405 is electrically connected to the electric wiring member 305 is sealed by sealant. The cap member 309 is welded to an upper opening of the ink supply retention member 306 to thereby seal the interior of the ink supply retention member 306. The cap member 309 allows the internal pressure of the ink supply retention member 306 to escape to the exterior by having an air communication path composed of a narrow opening and a minute groove communicating thereto.

Figure 6:
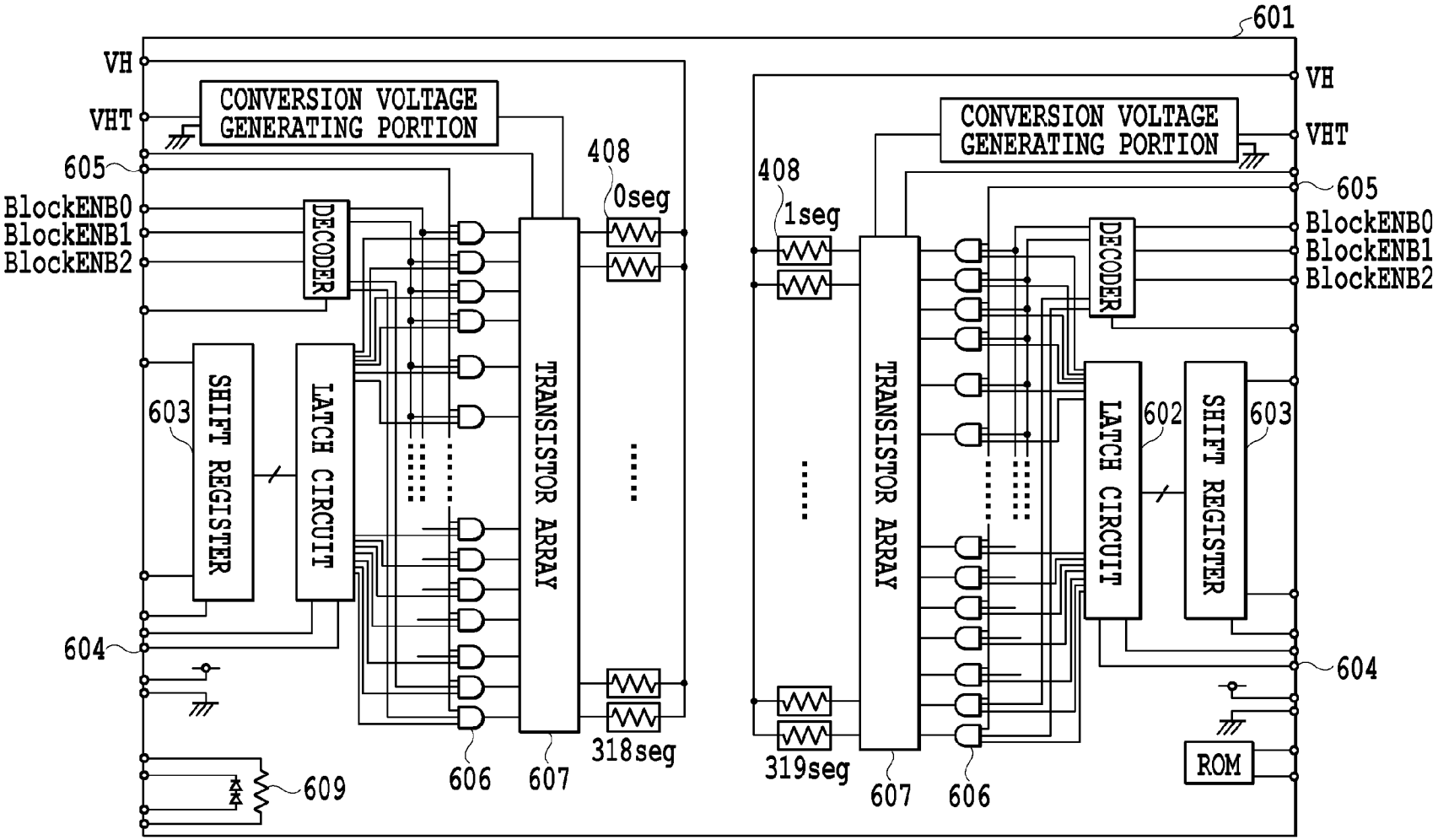
FIG. 6 is a circuit configuration diagram of the print head of FIG. 3A.

FIG. 6 illustrates a circuit configuration of the base body 601 of the print head 7.

On the base body 601, a latch circuit 602 latches, based on a latch signal inputted from an input terminal 604, printing data inputted from the control component of the inkjet printing apparatus. A shift register 603 is synchronized with a shift clock to serially input printing data and retain the data. A heat pulse signal for driving the heater 408 is inputted from an input terminal 605. The shift register 603 serially inputs and retains, in order to select the driving conditions of the heater 408, selection data stored in a ROM. The latch circuit 602 latches the selection data. An AND circuit 606 for each heater 408 calculates the logical sum of the heat pulse signal, the printing data signal, block signal, and the selection data. When an output from the AND circuit 606 is at a high level, a heater driving transistor in the corresponding transistor array 607 is turned ON and current flows in the heater 408 connected to the transistor to drive the heater 408 for heat generation.

Next, the operation of the print head 7 as described above will be described.

First, after the power source is turned ON, based on an ink foaming level for each base body 601 measured in advance, a pulse width of a heat pulse (including a pre-heat pulse and a main heat pulse) applied to each heater 408 is determined. The ink foaming level is determined by ranking minimum pulse values at which ink can be ejected when the heater 408 receives a heat pulse having a predetermined voltage under fixed temperature conditions. The width data of these heat pulses are transferred to the shift register 603 while being synchronized with the shift clock, thereby generating a voltage signal applied to the heater 408. The selection data, which is stored in the ROM in order to select the driving conditions of the heater 408, is latched by the latch circuit 602. The latch may be carried out only one time when the print head 7 is started for example. Depending on the pulse data selected based on the signal from the ROM, the pulse width of the heat pulse is determined so that energy appropriate for ink ejection can be applied to the heater 408. Depending on a value detected by a temperature sensor 609 (diode sensor) detecting the temperature of the print head 7, the pulse width of the pre-heat pulse and the timing at which the pre-heat pulse is applied are determined. Thus, various heat pulses (including the main heat pulse and the pre-heat pulse) can be set so that a fixed amount of ink can be ejected through the respective ejection openings even under various temperature conditions.

Figure 7:
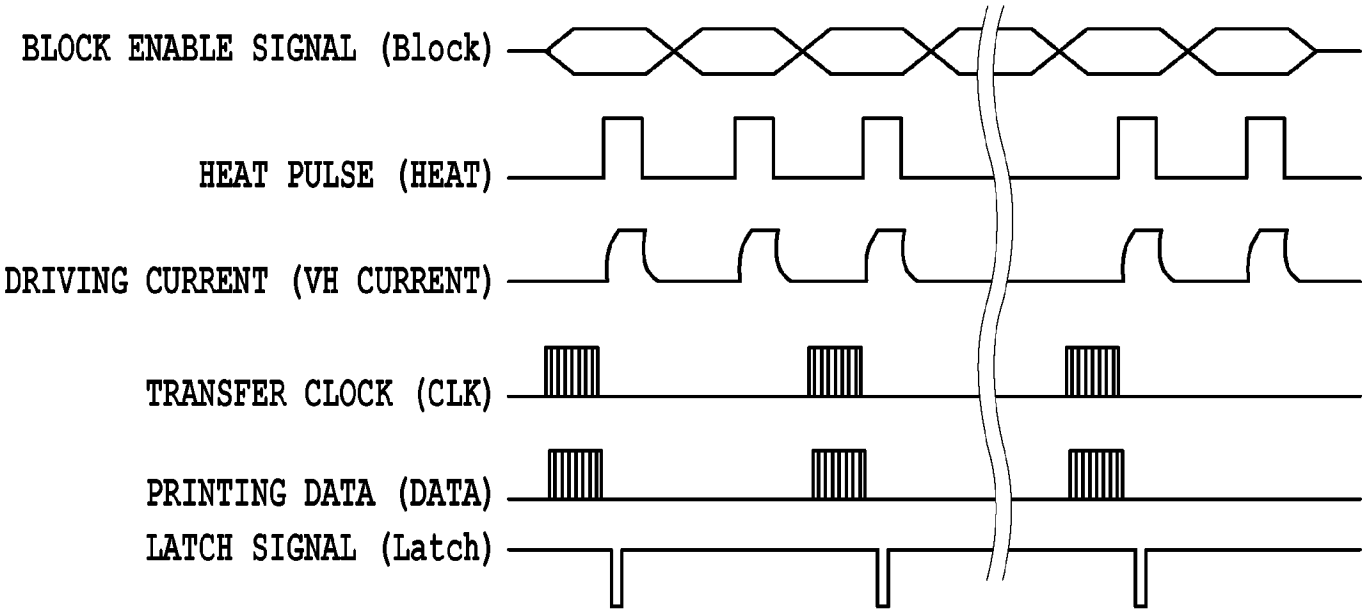
FIG. 7 is a time chart for explaining the timing at which the print head of FIG. 3A is driven.

FIG. 7 illustrates a driving timing of the print head 7. The print head 7 is configured so that the heaters 408 are divided into a plurality of blocks (groups) and the respective blocks are driven in a time-division manner.

Based on a transfer clock (CLK) supplied from the input terminal, the shift register 603 receives the printing data (DATA) serially inputted from the input terminal and outputs the printing data to the latch circuit 602 in a parallel manner. The latch circuit 602 retains the printing data based on a latch signal (Latch). The heaters 408 (320 heaters in the case of this example) are divided into the plurality of blocks (groups). Based on a block enable signal (Block) supplied from the input terminal, a block as a driving target is selected. The AND circuit 606 calculates the logical sum of the heat pulse (HEAT) outputted depending on the printing data and a signal selected and outputted based on the block enable signal to output a signal for turning ON the heater driving transistor in the transistor array 607. When the heater driving transistor is turned ON, driving current (VH current) flows in the heater 408 connected thereto, thereby driving the heater 408 for heat generation.

Figure 8:
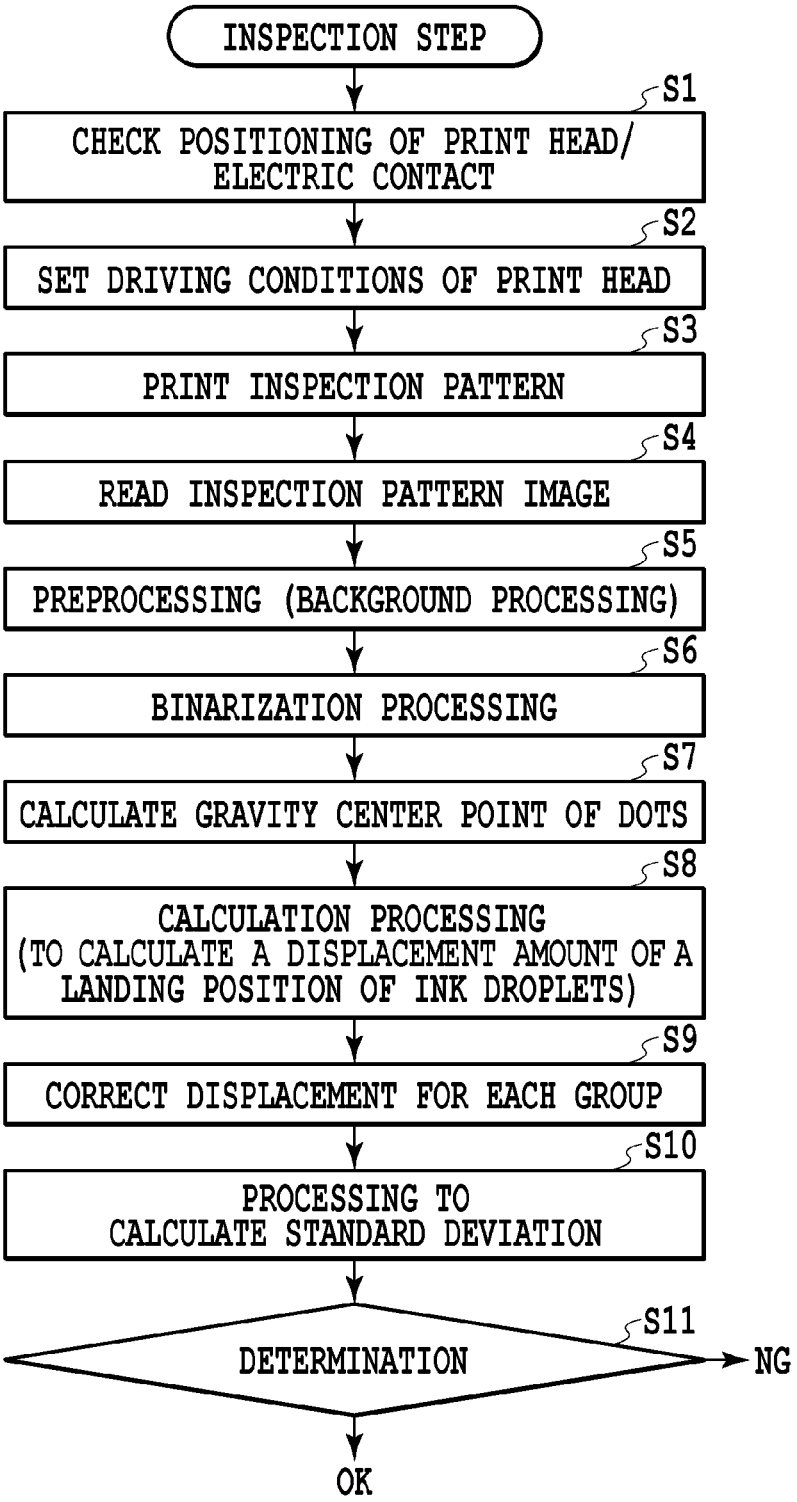
FIG. 8 is a flowchart for explaining an inspection step of the inspection apparatus of FIG. 1A.

FIG. 8 is a flowchart illustrating the inspection steps in the inspection apparatus of FIG. 1.

First, the positioning of the print head 7 to the head fixing portion 1 of the inspection apparatus is checked and the electric connection between the print head 7 and the inspection apparatus is checked (Step S1).

Next, the driving conditions of the print head 7 are set in order to print an inspection pattern for measuring a print ink droplet landing position (Step S2). Specifically, a resistance value of the heater 408 is measured. Based on the resistance value, the amount of ejection energy applied to the heater 408 for ejecting ink from the print head 7 (the pulse width of the driving pulse) is set. Furthermore, the voltage of the driving pulse applied to the heater 408 (e.g., 24.0 V) is set and the stage 12 is moved so that the print head 7 is opposed to the printing medium (e.g., paper) on the stage 12.

Thereafter, the inspection pattern is printed on the printing medium on the stage 12 (Step S3). During printing, while the stage 12 is moved at a predetermined speed, ink is ejected from the print head 7 based on the driving conditions set in advance. The moving speed of the stage 12 is determined based on the ink ejection characteristic of the print head 7 and is 25 inch/sec in the case of this example.

Figure 9A:
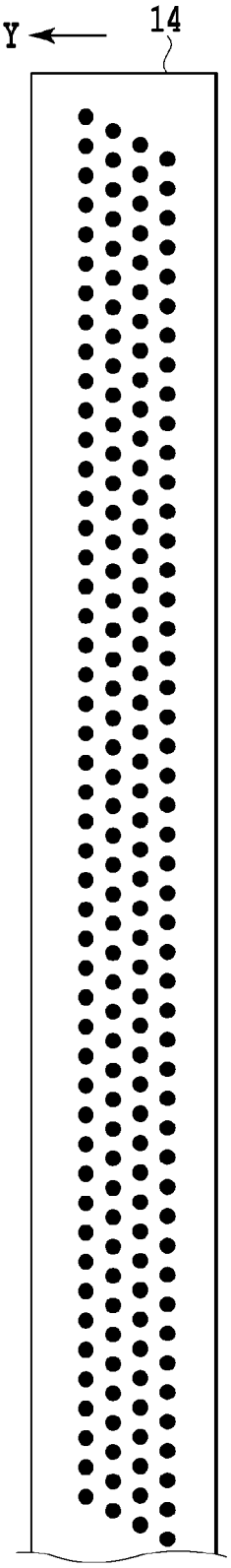
FIG. 9A and FIG. 9B illustrate an inspection pattern printed in the inspection step of FIG. 8.
Figure 9B:
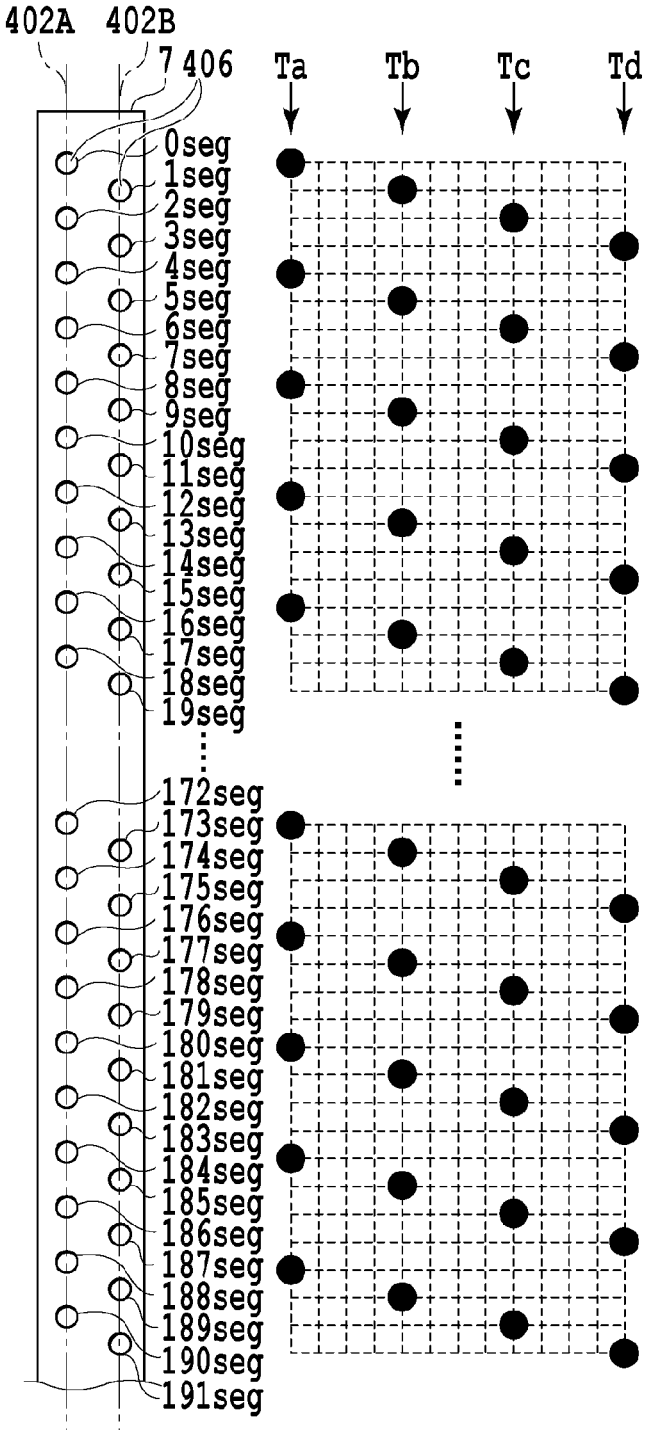

FIG. 9A illustrates the entirety of the inspection pattern printed on the printing medium 14 on the stage 12. FIG. 9B is an expanded view of a part of the inspection pattern. While allowing the printing medium 14 to move in the direction shown by the arrow Y, the respective blocks in the print head 7 are subjected to a time division driving. Ink is ejected at the same ejection timings Ta, Tb, Tc, and Td for every four segments to thereby print the inspection pattern.

Next, the image data of the printed inspection pattern is read (Step S4). Specifically, the stage 12 is moved so that the printing medium 14 on which the inspection pattern is printed is positioned in a measurement area of the camera 10. Then, while allowing the stage 12 to move at a speed determined based on the image reading characteristic of the camera 10, the inspection pattern is read by the camera 10. In the case of this example, the moving speed of the stage 12 was set to 25 inch/sec as in the printing of the inspection pattern.

The image data of the inspection pattern is subjected to a preprocessing (background processing) (e.g., a background noise removal and a shading correction) and is subsequently subjected to a binarization processing (Steps S5 and S6). Thereafter, gravity center points of dots formed by ink droplets landed on the printing medium 14 are calculated (Step S7). Based on the XY coordinate of the gravity center point, an ideal grid point as an ideal landing point is calculated by the least-square method. Based on the positional relation between the ideal grid point and the XY coordinate of the gravity center point of the dot in the vicinity thereof, displacement amounts of the landing positions of the ink droplets forming the respective dots are acquired (Step S8).

Figure 10:
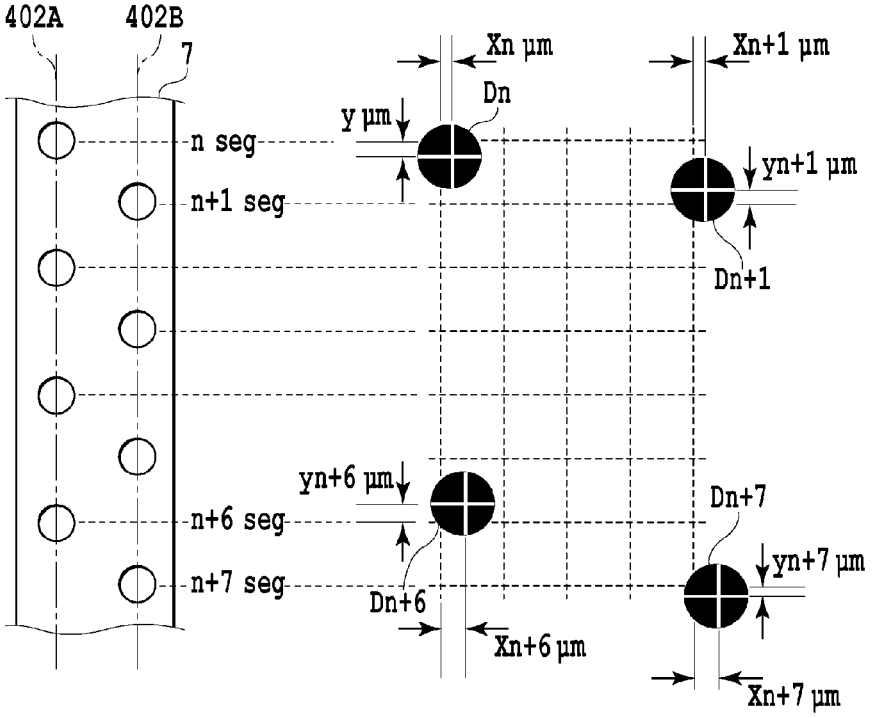
FIG. 10 illustrates displacement amounts of dots forming the inspection pattern of FIG. 9B.

FIG. 10 illustrates the displacement amount of the landing positions of the ink droplets. With regards to the n segments of the print head 7, the distance xn μm in the X direction and the distance Yn μm in the Y direction between the gravity center point of dot D1 formed by the ink droplet to be ejected and the corresponding ideal grid point are determined as displacement amounts in the X direction and the Y direction of the landing position. The same applies to other segments (dot Dn+1, dot Dn+6, and dot Dn+7 formed by the ink droplets ejected from n+1 segment, n+6 segment, and n+7 segment).

Figure 11:
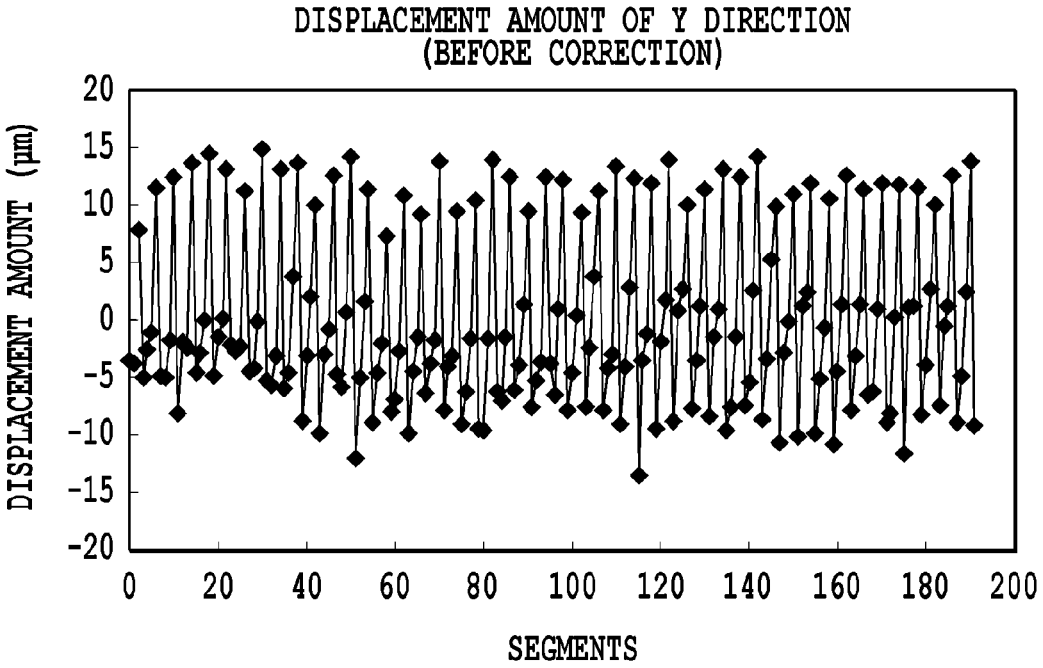
FIG. 11 is a graph illustrating the displacement amounts regarding segments of the print head in the Y direction.

FIG. 11 is a graph illustrating the displacement amounts in the Y direction of the landing positions of the respective segments. All segments (1 segment to 192 segment) have a standard deviation value (σ) of 7.70 of the displacement amounts in the Y direction of the landing position. The standard deviation value (σ) of 7.70 is a value at an NG level based on a standard. According to an observation by the present inventor, the inspection pattern image read by the camera is influenced by the vibration of an apparatus used to read the image (including an inspection apparatus and other surrounding apparatuses), as shown by the measurement by a laser displacement meter. In the case of the example of FIG. 11, high influence is caused by vibration at the third ink ejection timing Tc. Specifically, temporally-changing vibration is caused to have high influence at the ejection timing Tc.

Figure 12:
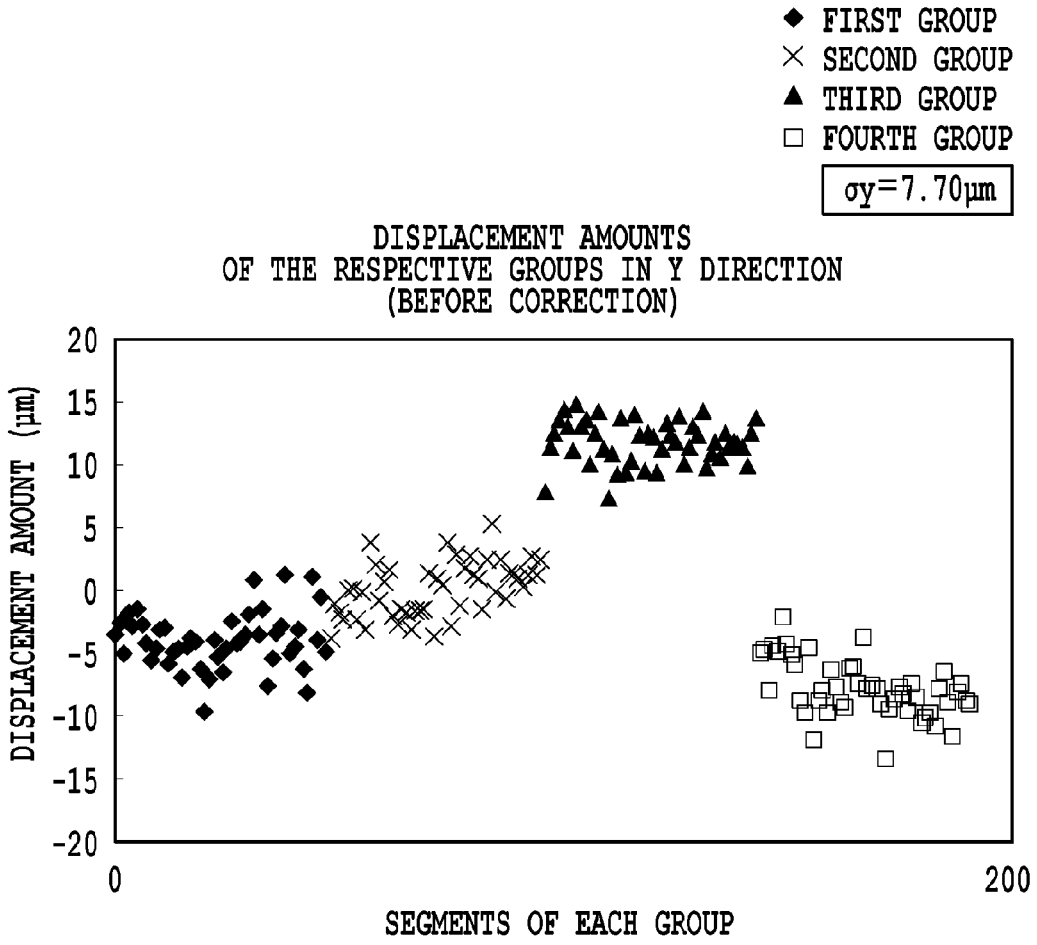
FIG. 12 is a graph illustrating the displacement amounts of FIG. 11 divided for each segment group.

FIG. 12 is a graph illustrating the displacement amounts in the Y direction of the landing position of FIG. 11 based on the respective ejection timings Ta, Tb, Tc, and Td of FIG. 9B. Specifically, segments having an ink ejection timing Ta are assumed as a first group, segments having an ink ejection timing Tb are assumed as a second group, segments having an ink ejection timing Tc are assumed as a third group, and segments having an ink ejection timing Td are assumed as a fourth group. As shown in FIG. 12, the respective segment groups clearly show the characteristics of the displacement amount in the Y direction of the landing position. The segments of the third group influenced by the vibration in particular show a high displacement amount of the landing positions.

In this embodiment, the characteristic of the displacement amount in the Y direction of the landing position of each segment group (each group) is used to correct the displacement amount. Thereafter, the displacement amounts σ in the Y direction of the landing positions in all segments are calculated. Specifically, as shown in FIG. 12, the segments are divided into groups for the respective ejection timings. For the respective groups, the displacement amounts in the Y direction of the landing positions are calculated. Then, in Step S9 of FIG. 8, the displacement amounts in the Y direction of the landing positions are corrected for the respective groups so that a difference of 0 is achieved between the displacement amounts in the Y direction of the landing positions of the respective groups and an average value of the displacement amounts in the Y direction of the landing positions of all segments.

FIG. 13 shows an arithmetic expression to calculate the average value of the displacement amounts in the Y direction of the landing positions.

Figure 15:
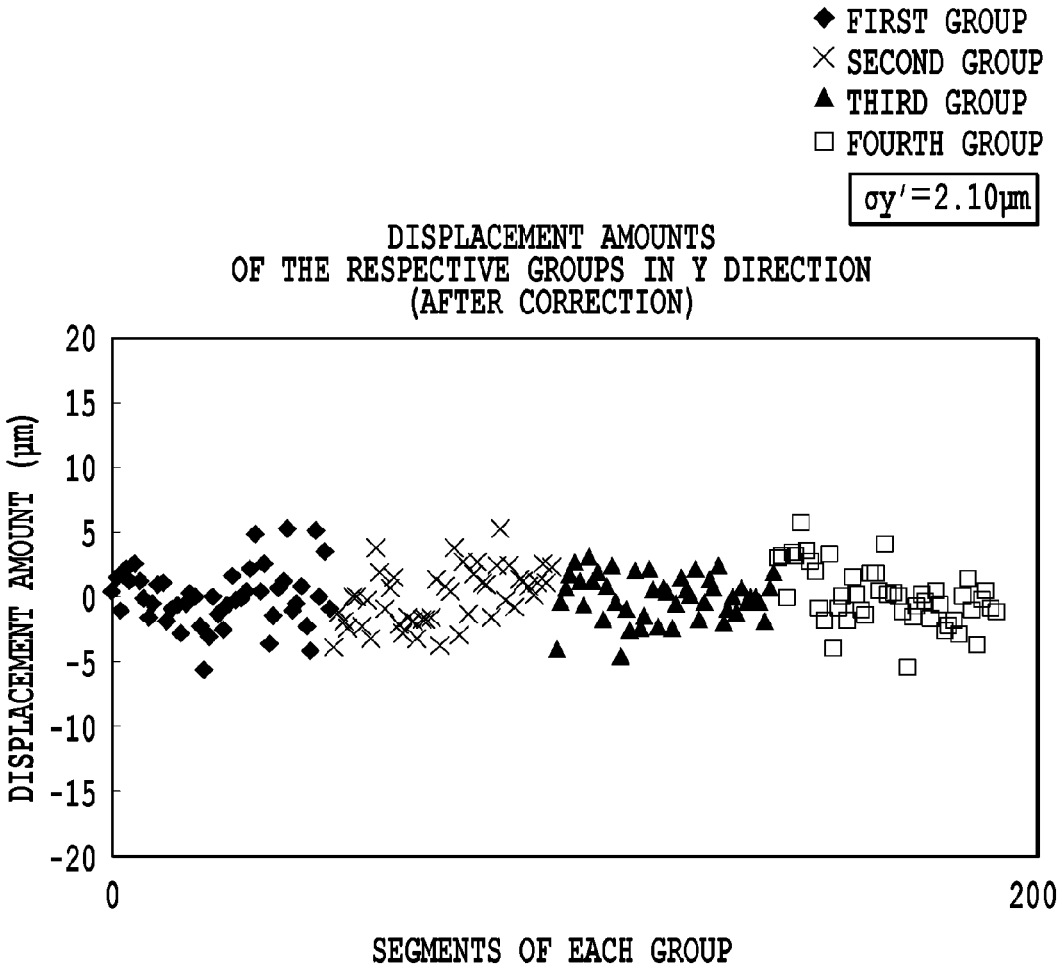
FIG. 15 is a graph illustrating the displacement amounts of FIG. 11 after being corrected and subsequently divided into the respective segment groups in the first embodiment of the present invention.
Figure 16:
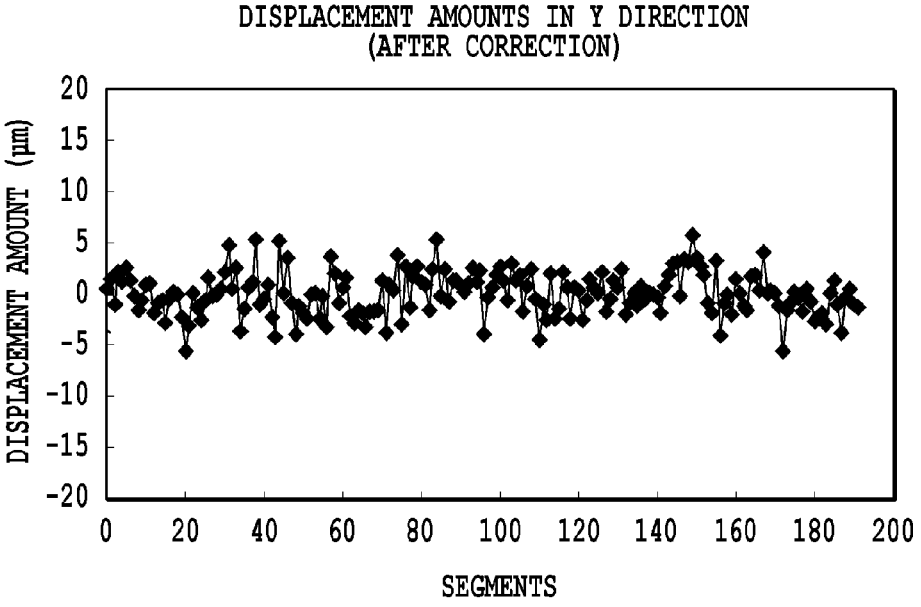
FIG. 16 is a graph illustrating the corrected displacement amounts of FIG. 11 in the first embodiment of the present invention.

A formula (1) is an arithmetic expression to calculate the average value of the displacement amounts in the Y direction of the landing positions for all segments. A formula (2) is an arithmetic expression to calculate an average value Ya of the displacement amounts in the Y direction of the landing positions for segments of the first group. Similarly, a formula (3) is an arithmetic expression to calculate an average value Yb for segments of the second group. A formula (4) is an arithmetic expression to calculate an average value Yc for segments of the third group. A formula (5) is an arithmetic expression to calculate an average value Yd for segments of the fourth group. A formula (6) is an arithmetic expression (i=0, 1, 2 . . . 48) of corrected displacement amounts $y'_{4i}$ in the Y direction of the landing positions for the segments of the first group. Similarly, a formula (7) is an arithmetic expression for corrected displacement amounts $y'_{4i+1}$ for the segments of the second group. A formula (8) is an arithmetic expression for corrected displacement amounts $y'_{4i+2}$ for the segments of the third group. A formula (9) is an arithmetic expression for corrected displacement amounts $y'_{4i+3}$ for the segments of the fourth group. FIG. 15 is a graph obtained by dividing the corrected displacement amounts in the Y direction to the first, second, third, and fourth groups. FIG. 16 is a graph illustrating the corrected displacement amounts in the Y direction in an order of the arrangement of the segments.

Thereafter, in Step S10 of FIG. 8, the standard deviations of the displacement amounts in the Y direction before correction and after correction are calculated. In FIG. 14, a formula (11) is an arithmetic expression to calculate a standard deviation ($\sigma_y$) of the displacement amount in the Y direction before correction. A formula (12) is an arithmetic expression to calculate a standard deviation ($\sigma y'$) of the displacement amount in the Y direction after correction.

As described above, the standard deviation ($\sigma_y$) of the displacement amount in the Y direction before correction influenced by the vibration is 7.70 while the standard deviation ($\sigma_{y'}$) of the displacement amount in the Y direction after correction is 2.10. The displacement amount in the Y direction after correction is approximated to the original displacement amount in the Y direction of the print head after the removal of the influence by vibration. Thus, based on a comparison result between the standard deviation of the displacement amount in the Y direction after correction and a reference standard deviation, the ink ejection performance of the print head can be inspected more accurately to more securely determine the acceptability of the print head in Step S11 of FIG. 8.

As described above, in this embodiment, ink is ejected from the segments divided to a plurality of groups having different ink ejection timings to print the inspection pattern. With regard to the respective groups, ink landing positions corresponding to the dot formation positions are corrected. As a result, the influence by the temporally-changing vibration on the printing and reading of the inspection pattern can be minimized and the ink landing position can be sensed more accurately to more securely determine the acceptability of the print head. Furthermore, the print head can be inspected in accurate and low-cost manner without requiring a special apparatus or mechanism.

Second Embodiment

In the case of this embodiment, in the above-described calculation processing of the standard deviation of the first embodiment (Step S10), the standard deviations of the displacement amounts in the Y direction after correction for the first, second, third, and fourth groups are calculated, respectively. In FIG. 17, a formula (21) is an arithmetic expression to calculate a standard deviation ($\sigma_{y'a}$) for the segments of the first group. A formula (22) is an arithmetic expression to calculate a standard deviation ($\sigma_{y'b}$) for the segments of the second group. Similarly, a formula (23) is an arithmetic expression to calculate a standard deviation ($\sigma_{y'c}$) for the segments of the third group. A formula (24) is an arithmetic expression to calculate a standard deviation ($\sigma_{y'd}$) for the segments of the fourth group. In the above-described example, the first group has a standard deviation of 2.23, the second group has a standard deviation of 2.17, the third group has a standard deviation of 1.74, and the fourth group has a standard deviation of 2.28. Furthermore, according to a formula (25) of FIG. 17, the standard deviations of the first group to the fourth group have a root-mean-square value of 2.12. This value is assumed as a standard deviation ($\sigma_{y'}$) of the displacement amounts of the print head in the Y direction.

As described above, the standard deviation ($\sigma_y$) of the displacement amount in the Y direction before correction influenced by the vibration is 7.70 while the standard deviation ($\sigma_{y'}$) of the displacement amount in the Y direction after correction is 2.12. The displacement amount in the Y direction after correction is approximated to the original displacement amount in the Y direction of the print head after the removal of the influence by vibration. Thus, based on the displacement amount in the Y direction after correction as described above, the ink ejection performance of the print head can be inspected more accurately to more securely determine the acceptability.

Third Embodiment

In this embodiment, an average value of the displacement amounts in the Y direction regarding the segments of each group is calculated. Then, when an absolute value of the average value is larger than 5 μm, the displacement amounts in the Y direction of the landing positions for the respective groups are corrected so that a difference of 0 is achieved between the average value of the displacement amounts in the Y direction of all segments and the average value of the displacement amounts in the Y direction of the segments of the respective groups. When the ink landing position is staggered in the Y direction as in above-described case for FIG. 11 and FIG. 12, the segments of the third group have an average value of the displacement amounts of 11.81 μm while the segments of the fourth group have an average value of the displacement amounts of −7.91 μm. In this case, the correction is carried out so that a difference of 0 is achieved between the average value of the displacement amounts of these groups and the average value of the displacement amounts of all segments.

Figure 18:
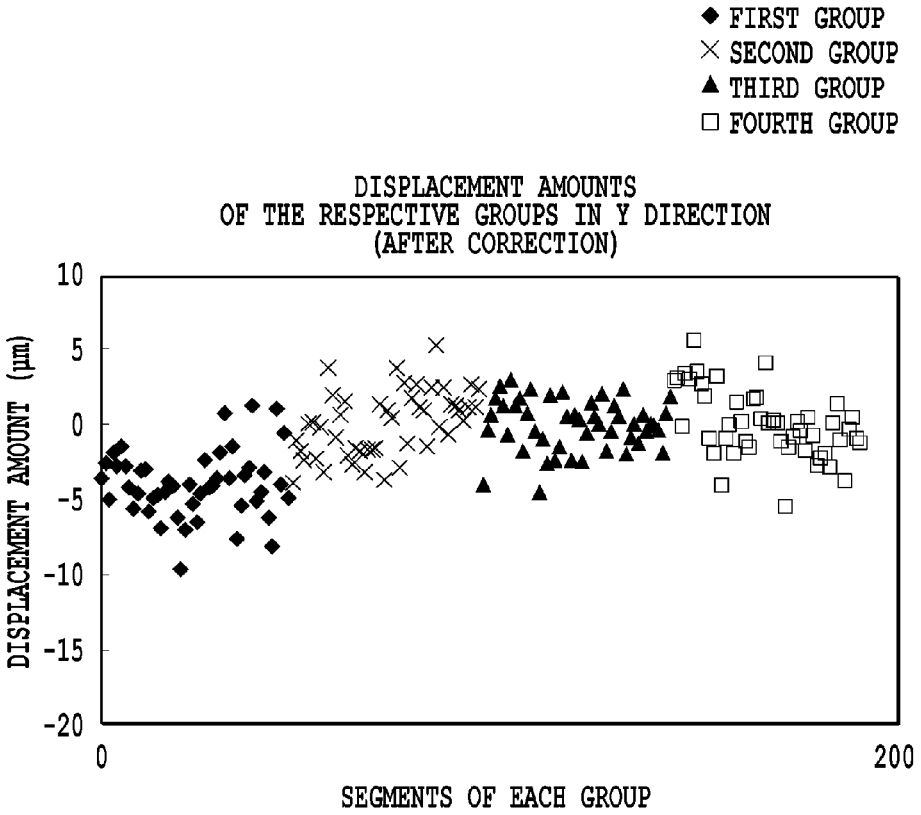
FIG. 18 is a graph illustrating the displacement amounts of FIG. 11 after being corrected and subsequently divided into the respective segment groups in the third embodiment of the present invention.

FIG. 18 shows the plot of the displacement amounts in the Y direction after correction divided to the first, second, third, and fourth groups. By correcting the displacement amounts as described above, the standard deviation of the displacement amount after correction is 2.71.

As described above, the standard deviation ($\sigma_y$) of the displacement amount in the Y direction before correction influenced by the vibration is 7.70 while the standard deviation ($\sigma_{y'}$) of the displacement amount in the Y direction after correction is 2.71. The displacement amount in the Y direction after correction is approximated to the original displacement amount in the Y direction of the print head after the removal of the influence by vibration. Thus, based on the displacement amount in the Y direction after correction as described above, the ink ejection performance of the print head can be inspected more accurately to more securely determine the acceptability.

Other Embodiments

During printing of the inspection pattern, the printing medium may be moved relative to the print head. The present invention also can widely be used, in addition to the inkjet print head through which ink can be ejected, as an inspection apparatus and an inspection method for inspecting a liquid ejection head through which various liquids other than ink can be ejected.

Embodiment (s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment (s) and/or that includes one or more circuits (e.g., application specific integrated circuit (ASIC)) for performing the functions of one or more of the above-described embodiment (s), and by a method performed by the computer of the system or apparatus by, for example, reading out and executing the computer executable instructions from the storage medium to perform the functions of one or more of the above-described embodiment (s) and/or controlling the one or more circuits to perform the functions of one or more of the above-described embodiment (s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260499, filed Dec. 17, 2013 which is hereby incorporated by reference wherein in its entirety.

What is claimed is:

1. An apparatus for inspecting an inkjet print head in which ink can be ejected through a plurality of ejection openings forming an ejection opening array, comprising:

a control unit configured to print a predetermined inspection pattern on a printing medium by dividing the plurality of ejection openings into a plurality of blocks to subject the inkjet print head to time division driving so that an ink ejection timing is staggered for each of the blocks, the predetermined inspection pattern being printed by ejection openings belonging to the plurality of blocks;

a reading unit configured to read the inspection pattern printed on the printing medium;

an acquisition unit configured to subject image data of the inspection pattern read by the reading unit to image processing to acquire position displacement amounts of dots formed on the printing medium by ink ejected through the ejection openings; and a correction unit configured to correct, for each block, position displacement of the dots on the basis of a correction amount while synchronizing ink ejection timings of the ejection openings belonging to a same block, the correction amount being set for each block based on the position displacement amounts of the dots acquired by the acquisition unit, the correction amount of each block being individually set based on the position displacement amounts of the dots formed by ink ejected through the ejection openings belonging to the corresponding block, wherein the acquisition unit acquires, for each dot, based on a positional relation between a gravity center point of the printed dot and an ideal grid point, the position displacement amount of the dot, and the ideal grid point is a point set by the least-square method so that a plurality of dots formed by ink ejected through the plurality of ejection openings have the minimum position error under a condition in which positions of the dots are fixed in an x direction and a y direction.

2. The apparatus for inspecting the inkjet print head according to claim 1, wherein the correction unit corrects the position displacement amounts for the respective blocks so that a difference of 0 is achieved between an average value of the position displacement amounts of all dots corresponding to the plurality of ejection openings and an average value of the position displacement amounts of the dots for the respective blocks.

3. The apparatus for inspecting the inkjet print head according to claim 1, further comprising:

a determination unit configured to determine an ink ejection status of the inkjet print head based on the position displacement amounts of the dots corrected by the correction unit.

4. The apparatus for inspecting the inkjet print head according to claim 3, wherein the determination unit determines the ink ejection status of the inkjet print head based on a comparison result between a standard deviation of the position displacement amounts, corrected by the correction unit, of all dots corresponding to the plurality of ejection openings and a reference standard deviation.

5. The apparatus for inspecting the inkjet print head according to claim 4, wherein the standard deviation of the position displacement amounts of all the dots is a root-mean-square value of a standard deviation of the position displacement amounts of the dots for the respective blocks after the correction by the correction unit.

6. A method of inspecting an inkjet print head in which ink can be ejected through a plurality of ejection openings forming an ejection opening array, comprising:

a printing step of printing a predetermined inspection pattern on a printing medium by dividing the plurality of ejection openings into a plurality of blocks to subject the inkjet print head to time division driving so that an ink ejection timing is staggered for each of the blocks, the predetermined inspection pattern being printed by ejection openings belonging to the plurality of blocks;

a reading step of reading the inspection pattern printed on the printing medium;

an acquisition step of subjecting image data of the inspection pattern read by the reading step to image processing to acquire position displacement amounts of dots formed on the printing medium by ink ejected through the ejection openings; and a correction step of correcting, for each block, position displacement of the dots on the basis of a correction amount while synchronizing ink ejection timings of the ejection openings belonging to a same block, the correction amount being set for each block based on the position displacement amounts of the dots acquired by the acquisition step, the correction amount of each block being individually set based on the position displacement amounts of the dots formed by ink ejected through the ejection openings belonging to the corresponding block, wherein the acquisition step acquires, for each dot, based on a positional relation between a gravity center point of the printed dot and an ideal grid point, the position displacement amount of the dot, and the ideal grid point is a point set by the least-square method so that a plurality of dots formed by ink ejected through the plurality of ejection openings have the minimum position error under a condition in which positions of the dots are fixed in an x direction and a y direction.

7. The apparatus for inspecting the inkjet print head according to claim 1, further comprising:

a calculating unit configured to calculate correction amounts, for each block, for correcting the position displacement amounts of dots on the basis of the position displacement amounts of dots acquired by the acquisition unit, wherein the correction unit corrects, for each block, the position displacement amounts of the dots on the basis of the correction amounts calculated by the calculating unit.

* * * * *